US005249144A

United States Patent [19]

Falk

[11] Patent Number: 5,249,144

[45] Date of Patent: Sep. 28, 1993

[54] PROGRAMMABLE OPTICAL ARITHMETIC/LOGIC UNIT

[75] Inventor: R. Aaron Falk, Renton, Wash.

[73] Assignee: The Boeing Company, Seattle, Wash.

[21] Appl. No.: 414,018

[22] Filed: Sep. 29, 1989

[51] Int. Cl.[5] ..... G06E 1/04

[52] U.S. Cl. ..... 364/713

[58] Field of Search ..... 364/713, 746, 822; 350/96.2

[56] References Cited

U.S. PATENT DOCUMENTS

| | | | |
|---|---|---|---|
| 4,363,106 | 12/1982 | Tai | 364/746 |
| 4,418,394 | 11/1983 | Tai | 364/746 |
| 4,797,843 | 1/1989 | Falk et al. | 364/713 |
| 4,910,699 | 3/1990 | Capps et al. | 364/746 |
| 4,948,959 | 8/1990 | Houk et al. | 364/746 X |

OTHER PUBLICATIONS

"The TTL Data Book for Design Engineers", Texas Instruments, Second Edition, 1976, pp. 7-271 through 7-281.

N. S. Szabo et al., "Residue Arithmetic and Its Applications to Computer Technology", McGraw-Hill Book Company, New York, 1977, pp. 12-37.

*Primary Examiner*—Tan V. Mai

*Attorney, Agent, or Firm*—Foley & Lardner

[57] ABSTRACT

A programmable optical arithmetic/logic device employs a first and second plurality of positionally encoded optical light paths. For arithmetic operations, these light paths represent residue numbers. The arithmetic/logic device includes first and second reordering units which are responsive to a third and fourth plurality of light sources serving to select one of a plurality of arithmetic or logic operations to be performed by the arithmetic/logic device. The arithmetic/logic device further employs an optical arithmetic/logic unit which is identically constructed for all of the selectable arithmetic/logic operations and which implements an optical table look-up function to obtain the desired output. Finally, the arithmetic/logic device used an output reordering device to reorder the output of the arithmetic/logic unit depending upon the originally selected arithmetic/logic operation. For arithmetic operations, the final output is provided as an output residue number representation.

11 Claims, 7 Drawing Sheets

Assembly of tables for programmable optical ALU

| $X_2 \backslash X_1$ | 0 | 1 |
|---|---|---|
| 0 | 0 | 0 |
| 1 | 0 | 1 |

FIG. 2a

| $X_2 \backslash X_1$ | 0 | 1 |
|---|---|---|
| 0 | 0 | 1 |
| 1 | 1 | 0 |

FIG. 2b

| $X_2 \backslash X_1$ | 0 | 1 | 2 |
|---|---|---|---|
| 0 | 0 | 1 | 2 |
| 1 | 1 | 2 | 0 |
| 2 | 2 | 0 | 1 |

FIG. 2c

| $X_2 \backslash X_1$ | 0 | 1 | 2 | 3 | 4 |
|---|---|---|---|---|---|
| 0 | 0 | 0 | 0 | 0 | 0 |
| 1 | 0 | 1 | 2 | 3 | 4 |
| 2 | 0 | 2 | 4 | 1 | 3 |
| 3 | 0 | 3 | 1 | 4 | 2 |
| 4 | 0 | 4 | 3 | 2 | 1 |

FIG. 3a

| $X_2 \backslash X_1$ | 0 | 1 | 2 | 4 | 3 |
|---|---|---|---|---|---|
| 0 | 0 | 0 | 0 | 0 | 0 |
| 1 | 0 | 1 | 2 | 4 | 3 |
| 2 | 0 | 2 | 4 | 3 | 1 |
| 4 | 0 | 4 | 3 | 1 | 2 |
| 3 | 0 | 3 | 1 | 2 | 4 |

FIG. 3b

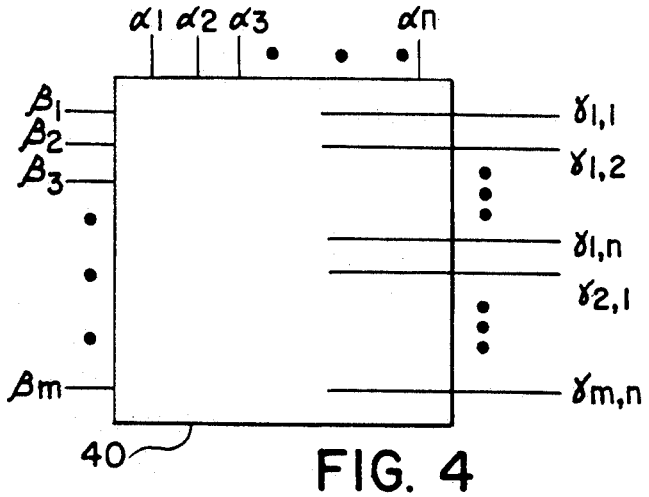

FIG. 4

| $\oplus$ | $g^0$ | $g^1$ | $g^2$ | $g^3$ | $\cdots$ | $g^{m-1}$ |
|---|---|---|---|---|---|---|
| $g^0$ | $g^0$ | $g^1$ | $g^2$ | $g^3$ | | $g^{m-1}$ |
| $g^1$ | $g^1$ | $g^2$ | $g^3$ | $g^4$ | | $g^0$ |
| $g^2$ | $g^2$ | $g^3$ | $g^4$ | $g^5$ | $\cdots$ | $g^1$ |
| $g^3$ | $g^3$ | $g^4$ | $g^5$ | $\cdot$ | | $g^2$ |
| $\vdots$ | | | $\vdots$ | | $\cdot$ | $\vdots$ |
| $g^{m-1}$ | $g^{m-1}$ | $g^0$ | $g^1$ | $g^2$ | $\cdots$ | $g^{m-2}$ |

$\oplus \equiv$ group operation $g^0 \equiv$ identify element $g^1 \equiv$ generator $g^i \equiv \underbrace{g^1 \oplus g^1 \oplus g^1 \oplus \cdots \oplus g^1}_{i}$ Operation Table for a Cyclic Group With m Elements

FIG. 5

| + | 0 | 1 | 2 | 3 | 4 |
|---|---|---|---|---|---|
| 0 | 0 | 1 | 2 | 3 | 4 |
| 1 | 1 | 2 | 3 | 4 | 0 |
| 2 | 2 | 3 | 4 | 0 | 1 |
| 3 | 3 | 4 | 0 | 1 | 2 |
| 4 | 4 | 0 | 1 | 2 | 3 |

$g^0 \equiv 0$ $g^1 \equiv 1$

FIG. 6a

| * | 1 | 3 | 4 | 2 |
|---|---|---|---|---|
| 1 | 1 | 3 | 4 | 2 |
| 3 | 3 | 4 | 2 | 1 |
| 4 | 4 | 2 | 1 | 3 |
| 2 | 2 | 1 | 3 | 4 |

$g^0 \equiv 1$ $g^1 \equiv 3$

Example of Cyclic Groups: a) Addition Modulo 5 b) Multiplication Modulo 5

| | 0 | 4 | 3 | 2 | 1 |
|---|---|---|---|---|---|
| 0 | 0 | 1 | 2 | 3 | 4 |
| 1 | 1 | 2 | 3 | 4 | 0 |
| 2 | 2 | 3 | 4 | 0 | 1 |
| 3 | 3 | 4 | 0 | 1 | 2 |
| 4 | 4 | 0 | 1 | 2 | 3 |

Module 5 subtraction table with reordered input

Symbol for general modulo arithmetic table

| | 0 | 1 | ••• | j | •• | m-1 |
|---|---|---|---|---|---|---|
| $C_1$ | $g_+^0$ | $g_+^1$ | ••• | $g_+^j$ | ••• | $g_+^{m-1}$ |
| $C_2$ | $g_+^0$ | $g_+^{m-1}$ | ••• | $g_+^{m-j}$ | ••• | $g_+^1$ |
| $C_3$ | 0 | $g_x^0$ | ••• | $g_x^j$ | ••• | $g_x^{m-1}$ |

| | 0 | 1 | ••• | j | ••• | m-1 |
|---|---|---|---|---|---|---|
| $C_1$ | 0 | 1 | ••• | j | ••• | m-1 |
| $C_2$ | 0 | m-1 | ••• | m-j | ••• | 1 |
| $C_3$ | 0 | 1 | ••• | $g_x^j$ | ••• | $g_x^{m-1}$ |

| | 0 | 1 | 2 | 3 | 4 |
|---|---|---|---|---|---|
| $C_1$ | 0 | 1 | 2 | 3 | 4 |
| $C_2$ | 0 | 4 | 3 | 2 | 1 |
| $C_3$ | 0 | 1 | 4 | 2 | 3 |

Example of Modulo 5 input reordering table

| | $a_0$ | $a_1$ | $a_2$ | $a_3$ | ••• | $a_{m-1}$ | $a_m$ | ••• | $a_{2m-2}$ |
|---|---|---|---|---|---|---|---|---|---|
| $C_1$ | 0 | 1 | 2 | 3 | ••• | m-1 | 0 | ••• | m-2 |
| $C_2$ | 0 | 1 | 2 | 3 | ••• | m-1 | 0 | ••• | m-2 |
| $C_3$ | 0 | 0 | 1 | $g_x^1$ | ••• | $g_x^{m-2}$ | $g_x^{m-1}$ | ••• | $g_x^{m-2}$ |

| | $a_0$ | $a_1$ | $a_2$ | $a_3$ | $a_4$ | $a_5$ | $a_6$ | $a_7$ | $a_8$ |
|---|---|---|---|---|---|---|---|---|---|
| $C_1, C_2$ | 0 | 1 | 2 | 3 | 4 | 0 | 1 | 2 | 3 |
| $C_3$ | 0 | 0 | 1 | 3 | 4 | 2 | 1 | 3 | 4 |

Example of output reordering table for modulo 5

Assembly of tables for programmable optical ALU

PROGRAMMABLE OPTICAL ARITHMETIC/LOGIC UNIT

BACKGROUND OF THE INVENTION

The invention relates generally to optical information processing, and in particular, to an optical crossbar apparatus for performing parallel optical logic and arithmetic operations and including programmable residue arithmetic functions.

There is a fundamental difference between optical circuits, in which the information carriers are photons, and electronic circuits, where the carriers are electrons. In the former case, the carriers do not interact with each other, while in the latter they do. This means that in optical devices there exist interconnect possibilities that do not exist with electronic hardware, in particular, interconnected parallel architectures which permit digital arithmetic and logic operations to be performed in a completely parallel, single step process. After the inputs are switched on, the output appears in the time it takes a photon to transit the device. No faster computation time is possible.

U.S. Pat. No. 4,797,843 as well as co-pending application Ser. No. 019,761 filed Feb. 27, 1987 of Falk et al describe optical arithmetic/logic units that perform the above-mentioned single step process by employing residue arithmetic. Residue arithmetic does not have a "carry" operation; that is, each "bit" in the representation is independent of the other. In residue arithmetic, each "bit" in a representation of a number is the decimal value of the number modulo the prime number corresponding to that position, called the modulus.

The optical cross-bar arithmetic/logic unit disclosed in the above-mentioned co-pending application utilizes crossed optical paths of light configured to define intersecting regions with each other corresponding to truth table or logic table inputs. The intensity of light at each intersecting region is detected to determine if two units of light intensity are present at each intersection, thereby indicating a particular logic state.

The aforementioned co-pending application operates utilizing a table look-up approach, referred to as a crossbar ALU, for performing the residue arithmetic. However, there is a need to perform multilevel logic and control functions and in particular programmable residue arithmetic functions. Such functions are important in implementing an all optical computer structure.

SUMMARY OF THE INVENTION

Accordingly, it is an object of the present invention to provide a system which utilizes the optical table look-up logic to perform specific control functions and the use of these functions being combined to perform programmable residue arithmetic functions. It should be noted that programmable logic is a critical part of any general purpose computer, and in particular, it is what transforms an ALU into a central processing unit.

The invention is directed to a programmable optical arithmetic device comprising:

1) a first plurality of light sources positionally encoded to represent a first set of inputs, energization of any one of said first plurality of light sources corresponding to a first residue number,
2) a second plurality of light sources positionally encoded to represent a second set of inputs, energization of any one of said second plurality of light sources corresponding to a second residue number,
3) a third plurality of light sources positionally encoded to represent a group of arithemetic or logic operations, energization of any one of said third plurality of light sources selecting one of said group of arithemetic or logic operations,
4) a fourth plurality of light sources positionally encoded to represent said group of arithemetic or logic operations, energization of any one of said fourth plurality of light sources selecting said one of said group of arithmetic or logic operations,
5) a first input reordering means responsive to said first and third plurality of light sources for reordering said first set of inputs to produce a first set of reordered inputs, said first input reordering means reordering said first set of inputs in accordance with said energized one of said third plurality of light sources corresponding to said selected one of said group of arithmetic or logic operations,
6) a second input reordering means responsive to said second and fourth plurality of light sources for reordering a second set of inputs to produce a second set of reordered inputs, said second input reordering means reordering said second set of inputs in accordance with said energized one of said fourth plurality of light sources corresponding to said selected one of said group of arithmetic or logic operations,
7) an optical arithmetic unit receiving said first set of reordered inputs and said second set of reordered inputs and generating a set of outputs, each output corresponding to said selected arithmetic or logic operation performed on said first set of inputs and said second set of inputs; and
8) an output reordering means responsive to said fourth plurality of light sources for receiving said set of outputs from said arithmetic/logic unit and for reordering said set of outputs in accordance with said selected arithmetic operation to provide a third residue number representative of the selected arithmetic operation on said first and second residue numbers.

The invention is more generally directed to an optical arithmetic/logic device comprising:

a first input reordering means for reordering a first set of inputs to produce a first set of reordered inputs, said first input reordering means reordering said first set of inputs in accordance with a selected one of a plurality of arithmetic operations to be performed;

a second input reordering means for reordering a second set of inputs to produce a second set of reordered inputs, said second input reordering means reordering said second set of inputs in accordance with said selected one of a plurality of arithmetic operations;

an arithmetic/logic unit receiving said first set of reordered inputs and said second set of reordered inputs and generating a set of outputs, each output corresponding to the selected arithmetic operation performed said first set of inputs and said second set of inputs; and an output reordering means for receiving said set of outputs from said arithmetic table means and reordering said set of outputs in accordance with said selected arithmetic operation.

BRIEF DESCRIPTION OF THE DRAWINGS

FIGS. 2A–2C show examples of possible truth tables that can be achieved by the optical cross-bar arithmetic/logic unit;

FIGS. 3A and 3B show a radix 5 residue multiplication table and its permutated table, respectively;

FIG. 4 shows the basic concept of an m by n table look-up device with multiple inputs and outputs;

FIG. 5 shows a general operation table for a cyclic group with m elements;

FIGS. 6A and 6B show an example of cyclic groups for addition modulo 5 and an example of cyclic groups for multiplication modulo 5, respectively;

FIG. 7 shows an example of a modulo 5 subtraction table with reordered inputs;

FIG. 8 shows a logic symbol for a general modular arithmetic table in accordance with the present invention;

DETAILED DESCRIPTION OF THE PREFERRED EMBODIMENTS

Figure 1:
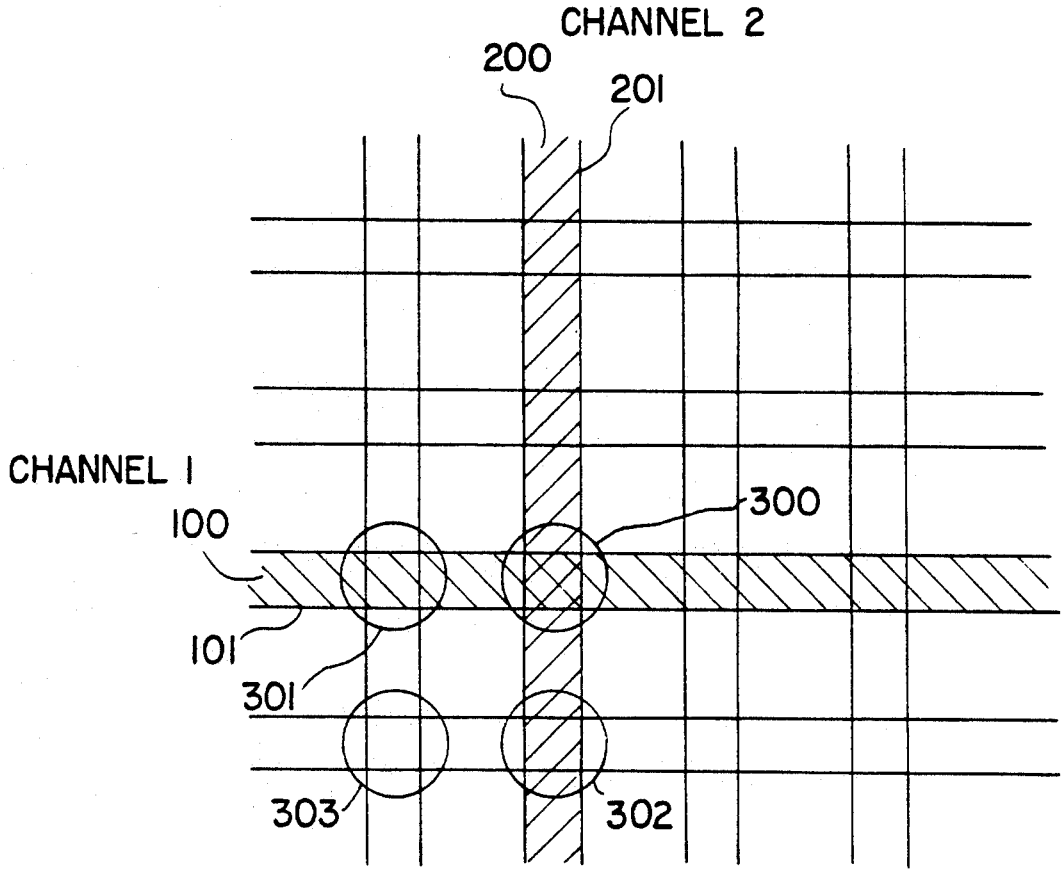
FIG. 1 is a schematic drawing showing the basic concept of the optical cross-bar arithmetic/logic unit.

Referring now to FIG. 1, the basic concept of the optical cross-bar arithmetic/logic unit (ALU), according to co-pending application Ser. No. 019,761, is shown using a 4×4 ALU. Input 100 from channel 1 and input 200 from channel 2 transmit light in optical paths 101 and 201 respectively to intersect at a region designated by reference number 300. Inputs 100 and 200 may comprise light sources coupled directly or indirectly to the optical paths 101 and 201 respectively. Thus, the level of light intensity at intersection region 300 is equivalent to two units of light. In comparison, the level of light intensity detected at intersecting regions 301 and 302 is only one unit of light, and the level of light intensity detected at intersecting region 303 is zero.

Some examples of possible truth tables that can be realized by the optical cross-bar ALU are shown in FIGS. 2 and 3. FIGS. 2*a* and 2*b* show examples of the kinds of two level logic tables associated with standard boolean algebra, the AND and EXCLUSIVE-OR tables, respectively. FIG. 2*c* shows an example of a multivalue logic table, specifically showing a table for radix 3 residue addition. The lack of carry operation is apparent, and thus makes parallel processing of residue addition possible. FIG. 3*a* shows a radix 5 residue multiplication table and FIG. 3*b* indicates how the reduced table (with zeros removed) can be made anti-diagonal via permutation, as discussed by Szabo and Tanaka in *Residue Arithmetic and its Applications to Computer Technology*, McGraw-Hill, New York, 1977 and incorporated herein by reference. These tables are representative examples only as it is apparent that all possible multi-level logic tables can be constructed in a similar fashion.

The basic table look-up concept is generalizable to multiple inputs and outputs as shown in FIG. 4. The general table 40 has two sets of inputs with dimensions of m and n and has m×n possible outputs. Only one output of the table 40 is on at a particular time, the output being determined by the intersection of the row and column of the two input states that are turned on and in accordance with the following equation:

$$L(\gamma_{ij}) = L(\beta_i).\ AND.\ L(\alpha_j) \qquad (1)$$

where the function L has a logic value of 1 if the state is on and 0 if the state is off. It should be noted that the input and output lines of table 40 can take on any logic or numerical value and, at the output, equivalent valued lines will be connected or logically ORed together. In the preferred embodiment, a positional notation is used with each input line or position assigned to a specific logic or numeric value, and only one line in a group is turned on at a particular time. The value of the on line determines the logic/numeric value of that group of lines. For example, musical notation can be an example of positional notation.

Figures 6B, 7, 8:
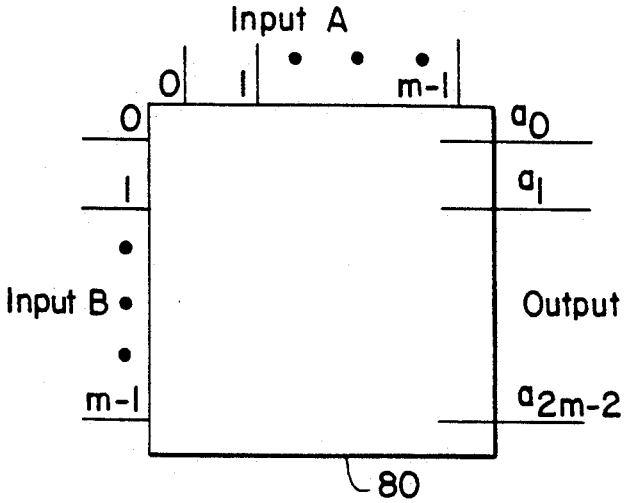

A multilevel look-up table logic can be used to perform residue arithmetic by using a set of n parallel modulo $m_i$ adders or multipliers. Of particular note is the fact that the required modulo $m_i$ operations of addition and multiplication (with the zeros removed) are part of the same cyclic group given that $m_1$ is a prime number. This is shown in the general operation table for a cyclic group with m elements in FIG. 5 and in the specific examples in FIGS. 6*a* and 6*b*. FIG. 6*a* shows examples of cyclic groups for addition modulo 5 and FIG. 6*b* shows examples of cyclic groups for multiplication modulo 5. The antidiagonal character of the tables is self evident, such that when the elements of each antidiagonal are connected together, there will be 2m−1 outputs for inputs of length m. This relationship between addition and multiplication means that (excluding the zeros) the same table can be used to perform both operations. Further, it can be readily shown that by reversing the order of the non-zero integers in one input to the table, modulo $m_i$ substraction becomes equivalent to addition. In other words, subtracting j from a particular value has the same operation as adding $m_i - j$ to that same value.

FIG. 7 shows an example of a modulo 5 subtraction table with the reordered input. Thus, a single table with the elements of the $2m_i - 1$ antidiagonals connected will perform all three basic operations given that the inputs and outputs are suitably reordered for each operation. A logic symbol for this general modular arithmetic table with inputs of length m(0 through m−1) and 2m−1 outputs (the ordered sequence of antidiagonals) is shown in FIG. 8. Table 80 of FIG. 8 includes Input A, having 0 through m−1 inputs, and Input B, having 0 through m−1 inputs and an output having $a_0$ through $a_{2m-2}$ separate output lines.

In order to complete the programmable optical ALU, look-up tables are required that will reorder the inputs to and the outputs from the general modular arithmetic table. For a particular one of the modulo m channels, it is expected that a 3×m table will be needed for one input, one row for each operation, and a 2×m table for the other. In the 2×m table, addition and subtraction are performed using the same values, thus it is the same table as the $3\times m$ table with the subtraction row removed.

Figures 9A, 9B, 9C:
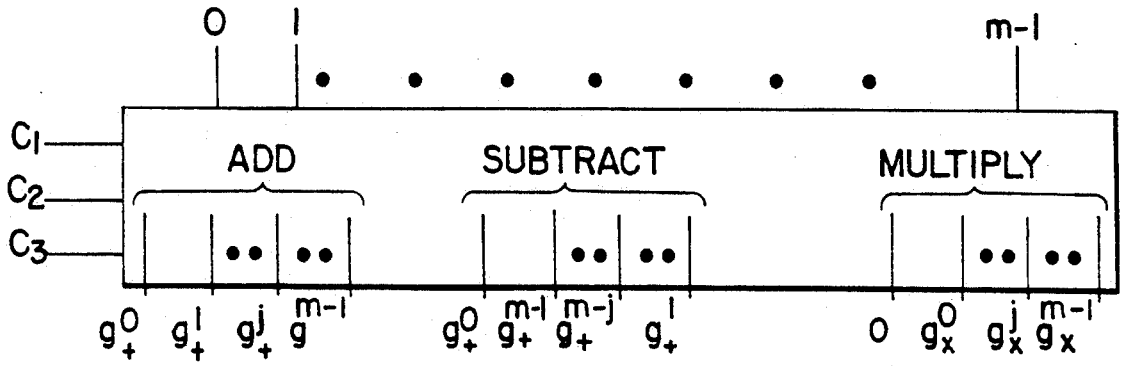
FIGS. 9A–9C show required input reordering tables and logic symbol, respectively, in accordance with the present invention.

FIGS. 9a–c show the required input tables and associated logic symbols. The symbols $g_+$ and $g_{33}$ refer to the addition and multiplication generators respectively, and $C_1$, $C_2$, and $C_3$ refer to addition, subtraction and multiplication, respectively. The inputs $C_1$, $C_2$, and $C_3$ are enabled by associated hardware in accordance with the desired arithmetic operation to be performed. The table of FIG. 9a associates the input value j with the corresponding power of the group generator g. In other words, the value in the $j^{th}$ column, k, is given by $$k=g^j \tag{2}$$

Figures 10, 11A, 11B, 12:
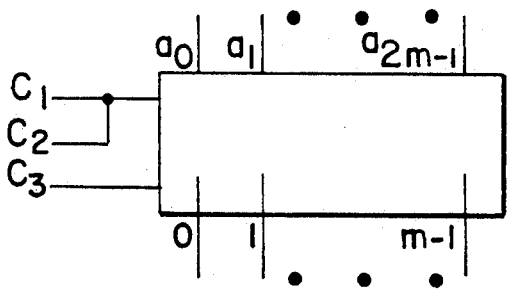
FIG. 10 shows a specific example of a modulo 5 input reordering table.
FIGS. 11A and 11B show a reordering table and logic symbol, respectively, for the desired output reordering table according to the present invention.
FIG. 12 shows an example of an output reordering table for modulo 5.

As will be come apparent, the outputs of the table will be logically ORed according to the value of k. As the addition generator is known, i.e. 1, these values can be shown explicitly as is done in FIG. 9b. The logic symbol for this table is shown in FIG. 9c. For a further example, FIG. 10 shows a specific example of the look-up table values for modulo 5.

The desired output reordering table will be a $2\times(2m-1)$ table. The required table with all three operations is shown in FIG. 11a and, as is readily apparent, the addition and subtraction rows are identical. The table ordering is simply the ordering of the antidiagonals shown in FIG. 5 except that the first two positions of the multiply row are filled with zeros. Once again, equivalent values in the tables will be connected or logically ORed together. The logic symbol for this table with the ORed operation is shown in FIG. 11b. FIG. 12 is provided in order to illustrate a specific example of an output reordering table for modulo 5.

Figure 13:
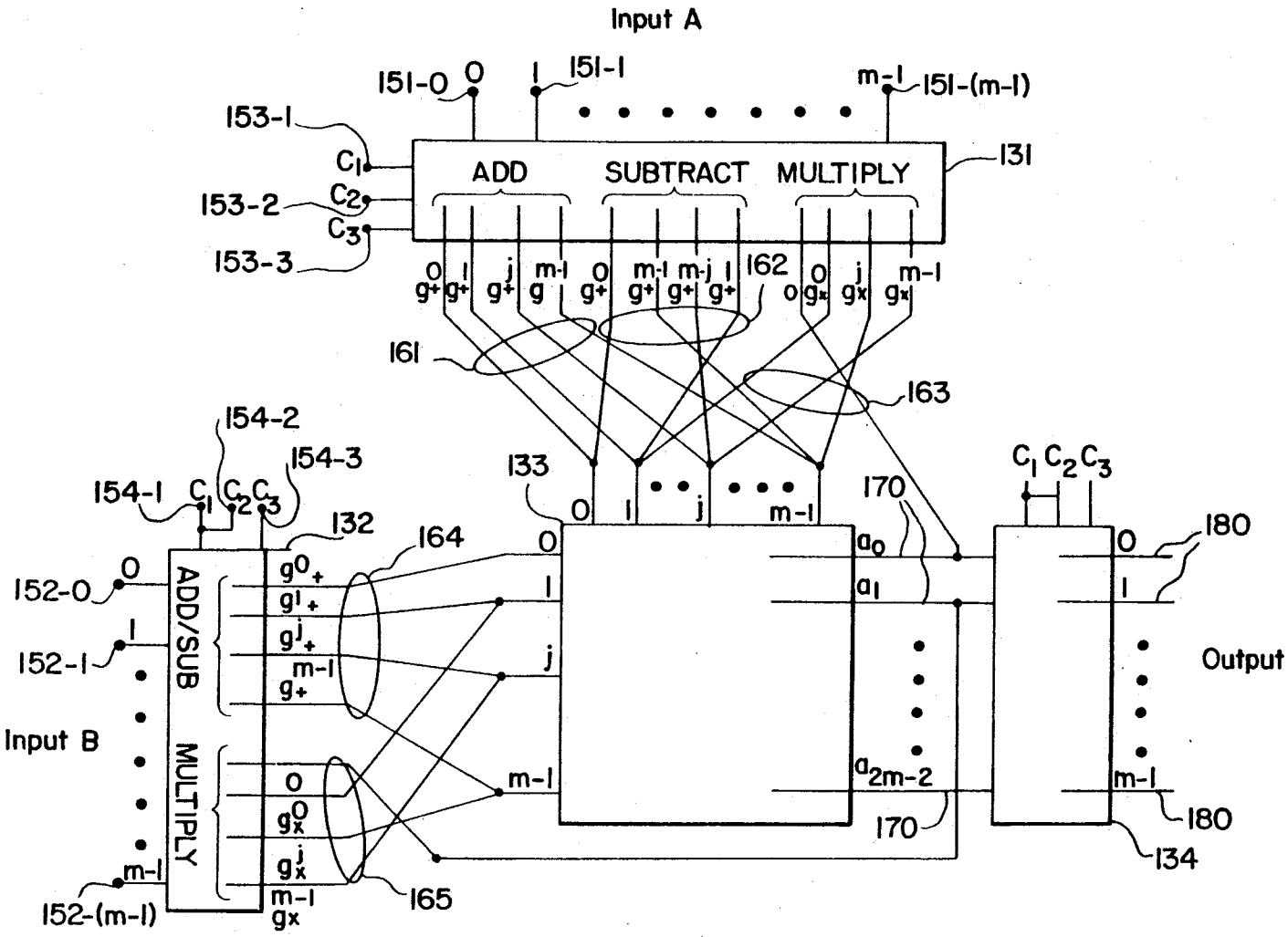
FIG. 13 shows an assembly of tables for the programmable optical ALU according to the present invention.

The final configuration for the programmable optical ALU is shown in FIG. 13. There are two input reordering tables, 131 and 132, one for each input. One of the tables is a $3\times m$ table and the other is a $2\times m$ table as only one of the inputs needs to be reordered for subtraction. The explicit form of the connection of the outputs from these tables 131 and 132 to form the input to the general modular arithmetic unit 133 is illustrated by FIG. 13. In other words, assuming C has been enabled so that an addition operation is carried out, the table 131 inputs 0, 1, . . . m−1 are reordered as the respective values $g_+^0, g_+^1, \ldots g_+^j, \ldots g_+^{m-1}$. These respective reordered values are in turn "hardwired" (directly coupled via optically conducting means such as optical fibers) to the inputs 0,1, . . . j, . . . m−1 of the general modular arithmetic unit 133 which itself is implemented as per FIGS. 1–4 and co-pending application Ser. No. 019,761, or as per U.S. Pat. No. 4,797,843. Similar connections are made with respect to the reordered inputs of the table 132 to the inputs of general modular arithmetic unit 133.

The output from unit 133 is then sent to the output reordering table 134. In order to achieve multiplication by zero, the zero lines from the multiply channel of the input tables 131 and 132 are connected directly to the output reordering table 134. In other words, the general modular arithmetic unit 133 will be missing at least one input if one or both of the multiply zero lines is on and no output will result from that source. Thus, the reason for the two zeros in the output reordering table for multiplication is now made apparent. It should by noted, that for data synchronization, a delay may be needed in these two bypass lines.

It should be appreciated that the embodiment disclosed in FIG. 13 comprises an all optical arithmetic/logic device. Thus, the unit 131 is connected to receive a first plurality of light sources 151-0 through 151-(m−1), and unit 132 is connected to receive a second plurality of light sources 152-0 through 152-(m−1). Each of the first and second plurality of light sources is positionally encoded to represent a first and second set of inputs respectively. Energization of any one of the first set of light sources 151-0 through 151-(m−1) corresponds to the input of a first residue number into the unit 131. Similarly, energization of any one of the second plurality of light sources 152-0 through 152-(m−1) corresponds to the input of a second residue number into the unit 132.

A third plurality of light sources 153-1 through 153-3 is also provided to unit 131. This third plurality of light sources is also positionally encoded such that the energization of any one of these light sources is operative to select a particular one of a group of arithmetic or logic operations to be performed by the arithmetic/logic unit 133. Similarly, a fourth plurality of light sources 154-1 through 154-3 is provided to unit 132, although as indicated above, sources 154-1 and 154-2 are tied together so only one actual source is needed here. In the fourth plurality of light sources, the actual source that is energized corresponds to the energized source selected in the third plurality of light sources. Thus, if multiplication is selected to be performed on the first and second residue numbers, sources 153-3 and 154-3 would both be energized.

Units 131 and 132 may be termed first and second input reordering means respectively since their purpose is to reorder the inputs depending upon the particular arithmetic/logic operation which is desired to be performed. As indicated above, the units 131 and 132 may be implemented using the optical cross-bar arithmetic/logic unit as disclosed in connection with FIGS. 1–3 herein and in co-pending application Ser. No. 019,761.

The outputs of units 131 and 132, termed first and second sets of reordered inputs, are fed as optical signals along lines 161–165 to the arithmetic/logic unit 133. Since these inputs are already reordered, the arithmetic/logic unit 133 will automatically perform the desired arithmetic/logic operation since this operation was effectively selected by the energization of one of the third and fourth plurality of light sources. Thus, the selected arithmetic/logic operation is provided as a set of outputs 170 from the arithmetic/logic unit 133.

Finally, the set of outputs 170 from the arithmetic/logic unit is fed to unit 134 which serves as an output reordering means to reorder the outputs 170 to provide reordered outputs 180. For this purpose the unit 134 is responsive to either one of the third or fourth plurality of light sources which, as indicated above, are used to select the desired arithmetic/logic operation. It is this sense that the device shown in FIG. 13 is programmable, namely, one may select or "program" the device to perform any one of a plurality of arithmetic or logic operations depending upon which reordering of the inputs and outputs is effected via selective energization of the third and fourth plurality of light sources.

It will also be appreciated that while the specific implementation of the device of FIG. 13 has been shown by way of a group of arithmetic operations, the invention is equally applicable to a plurality of logic operations (OR, AND XOR, etc.) or to a mixture of both. This is evident to those skilled in the art in view of the truth tables shown in FIGS. 2–3 and the realization that both arithmetic and logic operations are implemented simply by an optical table look-up technique in accordance with the above mentioned co-pending application.

As a result, a device for obtaining a programmable optical ALU using residue arithmetic is provided. Although the general modular arithmetic or logic operations of arithmetic/logic unit 133 can be obtained using the optical ALU devices described in co-pending application Ser. No. 019,761, or U.S. Pat. No. 4,797,843, the input and output reordering tables require the more general table look-up device described in co-pending application Ser. No. 019,761. The device described herein can be used as a part of a general purpose computer CPU.

Although the invention has been described relative to specific embodiments thereof, it is not so limited, and numerous variations and modifications thereof will be readily apparent to those skilled in the art in light of the above teaching. It is therefore to be understood that within the scope of the appended claims the invention may be practiced otherwise than as specifically described.

What is claimed is:

1. An optical arithmetic/logic device comprising:

a first input reordering means for reordering a first set of optical inputs to produce a first set of reordered optical inputs, said first input reordering means reordering said first set of optical inputs in accordance with a selected one of a plurality of arithmetic operations to be performed, said selected one of said plurality of arithmetic operations designated by select signals;

a second input reordering means for reordering a second set of optical inputs to produce a second set of reordered optical inputs, said second input reordering means reordering said second set of optical inputs in accordance with said selected one of said plurality of arithmetic operations;

an arithmetic/logic unit receiving said first set of reordered optical inputs and said second set of reordered optical inputs and generating a set of optical outputs, said optical outputs corresponding to said selected arithmetic operation performed on said first set of optical inputs and said second set of optical inputs, said arithmetic/logic unit configured for performing each of said plurality of arithmetic operations independently of said select signals; and an output reordering means for receiving said set of optical outputs and for reordering said set of optical outputs in accordance with said selected arithmetic operation.

2. An optical arithmetic/logic device as claimed in claim 1, wherein said plurality of arithmetic operations include addition, subtraction, and multiplication.

3. An optical arithmetic/logic device as claimed in claim 2, wherein said second set of reordered optical inputs are the same for the selected operations of addition and subtraction.

4. An optical arithmetic/logic device as claimed in claim 1, wherein said arithmetic/logic unit performs residue arithmetic operations on said first and second sets of reordered optical inputs.

5. An optical arithmetic/logic device as claimed in claim 1 wherein said first and second input reordering means, and said output reordering means comprise optical cross-bar look-up tables.

6. A programmable optical arithmetic device comprising:

1) a first plurality of light sources positionally encoded to represent a first set of optical inputs, energization of any one of said first plurality of light sources corresponding to a first residue number, 2) a second plurality of light sources positionally encoded to represent a second set of optical inputs, energization of any one of said second plurality of light sources corresponding to a second residue number, 3) a third plurality of light sources positionally encoded to represent a group of arithmetic or logic operations, energization of any one of said third plurality of light sources selecting one of said group of arithmetic or logic operations, 4) a fourth plurality of light sources positionally encoded to represent said group of arithmetic or logic operations, energization of any one of said fourth plurality of light sources selecting said one of said group of arithmetic or logic operations, 5) a first input reordering means responsive to said first and third plurality of light sources for reordering said first set of optical inputs to produce a first set of reordered optical inputs, said first input reordering means reordering said first set of optical inputs in accordance with said energized one of said third plurality of light sources corresponding to said selected one of said group of arithmetic or logic operations, 6) a second input reordering means responsive to said second and fourth plurality of light sources for reordering a second set of optical inputs to produce a second set of reordered optical inputs, said second input reordering means reordering said second set of optical inputs in accordance with said energized one of said fourth plurality of light sources corresponding to said selected one of said group of arithmetic or logic operations, 7) an optical arithmetic unit receiving said first set of reordered optical inputs and said second set of reordered optical inputs and generating a set of optical outputs, said optical outputs corresponding to said selected arithmetic or logic operation performed on said first set of optical inputs and said second set of optical inputs, said optical arithmetic unit configured for performing each operation of said group of arithmetic or logic operations independently of energization of said third plurality of light sources and said fourth plurality of light sources; and 8) an output reordering means responsive to said fourth plurality of light sources for receiving said set of optical outputs from said arithmetic unit and for reordering said set of optical outputs in accordance with said selected arithmetic operation to provide a third residue number representative of the selected arithmetic operation on said first and second residue numbers.

7. A programmable arithmetic device as claimed in claim 6, wherein said plurality of arithmetic or logic operations include addition, subtraction, and multiplication.

8. A programmable arithmetic device as claimed in claim 6, wherein said arithmetic unit performs residue arithmetic operations on said first and second sets of reordered optical inputs.

9. A programmable arithmetic device as claimed in claim 7, wherein said second set of reordered optical inputs are the same for the selected operations of addition and subtraction.

10. A programmable arithmetic device as claimed in claim 6, wherein said first and second input reordering means, and said output reordering means comprise optical cross-bar look-up tables.

11. A programmable optical arithmetic device comprising:

1) a first plurality of light sources representative of a first set of optical inputs, energization of any one of said first plurality of light sources corresponding to a first residue number,
2) a second plurality of light sources representative of a second set of optical inputs, energization of any one of said second plurality of light sources corresponding to a second residue number,
3) a third plurality of light sources representative of a group of arithmetic operations, energization of any one of said third plurality of light sources selecting one of said group of arithmetic operations,
4) a fourth plurality of light sources representative of said group of arithmetic operations, energization of any one of said fourth plurality of light sources selecting said one of said group of arithmetic operations,
5) a first input reordering means responsive to said first and third plurality of light sources for reordering said first set of optical inputs to produce a first set of reordered optical inputs, said first input reordering means reordering said first set of optical inputs in accordance with said energized one of said third plurality of light sources corresponding to said selected one of said group of arithmetic operations,
6) a second input reordering means responsive to said second and fourth plurality of light sources for reordering said second set of optical inputs to produce a second set of reordered optical inputs, said second input reordering means reordering said second set of optical inputs in accordance with said energized one of said fourth plurality of light sources corresponding to said selected one of said group of arithmetic operations,
7) an optical arithmetic unit receiving said first set of reordered optical inputs and said second set of reordered optical inputs and generating a set of optical outputs, said optical outputs corresponding to said selected arithmetic operation performed on said first set of optical inputs and said second set of optical inputs, said optical arithmetic unit configured for performing each arithmetic operation of said group of arithmetic operations independently of energization of said third plurality of light sources and said fourth plurality of light sources; and
8) an output reordering means responsive to one of said third or fourth plurality of light sources for receiving said set of optical outputs from said arithmetic unit and for reordering said set of optical outputs in accordance with said selected arithmetic operation to provide a third residue number representative of the selected arithmetic operation on said first and second residue numbers.

* * * * *